US009347721B2

(12) United States Patent
Larson, Jr.

(10) Patent No.: US 9,347,721 B2
(45) Date of Patent: May 24, 2016

(54) MAGAZINE FOR FIREARM

(71) Applicant: Rock River Arms, Inc., Colona, IL (US)

(72) Inventor: Lester C. Larson, Jr., Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 0 days.

(21) Appl. No.: 14/591,956

(22) Filed: Jan. 8, 2015

(65) Prior Publication Data

US 2015/0192377 A1 Jul. 9, 2015

Related U.S. Application Data

(60) Provisional application No. 61/925,448, filed on Jan. 9, 2014.

(51) Int. Cl.
*F41A 9/70* (2006.01)
*F41A 9/65* (2006.01)
*F41A 9/69* (2006.01)

(52) U.S. Cl.
CPC ... *F41A 9/70* (2013.01); *F41A 9/65* (2013.01); *F41A 9/69* (2013.01)

(58) Field of Classification Search
CPC ..... F41A 9/65; F41A 9/70; F41A 9/69
USPC ..... 89/33.1, 33.01, 197, 195; 42/11, 17, 21, 42/22, 18, 24, 29, 33, 35, 37, 39, 7, 49.01, 42/50, 6
See application file for complete search history.

(56) References Cited

U.S. PATENT DOCUMENTS 1,858,862 A * 5/1932 Loomis ..... F41A 9/70 42/50
2,903,809 A * 9/1959 Stoner ..... F41A 9/65 42/50
3,399,480 A * 9/1968 Rowe, Jr. ..... F41A 9/69 42/50
3,736,686 A * 6/1973 Moller ..... F41A 9/83 42/50
4,638,581 A * 1/1987 Moore ..... F41A 35/06 42/7
4,876,813 A * 10/1989 Tuma ..... F41A 9/70 42/50
5,507,110 A * 4/1996 Chesnut ..... F41A 9/65 42/50
5,664,355 A * 9/1997 Ronkainen ..... F41A 9/65 42/18
8,006,423 B1 * 8/2011 Alzamora ..... F41A 9/65 42/49.01
8,166,692 B2 * 5/2012 Fitzpatrick ..... F41A 9/70 42/50
2005/0223614 A1 * 10/2005 Pikielny ..... F41A 9/65 42/50
2009/0107022 A1 * 4/2009 Fitzpatrick ..... F41A 9/70 42/50
2013/0097909 A1 * 4/2013 Watchorn ..... F41A 9/65 42/50
2013/0227870 A1 * 9/2013 Rendulic ..... F41A 9/65 42/50

* cited by examiner

*Primary Examiner* — Samir Abdosh
*Assistant Examiner* — John D Cooper
(74) *Attorney, Agent, or Firm* — Banner & Witcoff, Ltd.

(57) ABSTRACT

A magazine for a firearm includes a body having a bottom end, a feed end side walls, first and second end walls, a channel on the first end wall, and vertically extending side ridges on the side walls; and a follower including a ridge configured to mate with the channel in the first end wall of the body; a plurality of vertically extending side channels configured to mate with the side ridges of the body; and an arcuate feed surface with an end point of a radius defining the arcuate feed surface being laterally offset from a vertically extending centerline of the follower; and a biasing member configured to urge the follower away from the bottom end.

26 Claims, 6 Drawing Sheets

MAGAZINE FOR FIREARM

CROSS-REFERENCE TO RELATED APPLICATION

This application claims priority to U.S. Provisional Application Ser. No. 61/925,448, filed Jan. 9, 2014, which is incorporated herein by reference.

FIELD

The present invention relates generally to an improved magazine for a firearm.

BACKGROUND

It is known that ammunition magazines are used with firearms. The typical magazine includes a magazine casing that defines a housing or body in which the ammunition is stored. The typical magazine also includes a follower that is spring-urged from the floor of the magazine toward the feed end of the magazine. The feed end of the magazine is inserted in the magazine well of the firearm and interacts with the bolt assembly of the firearm. During loading of the ammunition into the magazine, the ammunition cartridge pushes the follower down towards the floor and compresses the spring, which is acting against the follower. In operation, when one cartridge of ammunition is stripped out of the magazine by the firearm's bolt, the compressed spring pushes or urges the follower and remaining ammunition up toward the feed end, and the next cartridge is then put in position to be removed by the bolt for firing.

There remains a need, however, for an improved magazine for an AR-style firearm, that reduces splay or wobble of the follower and that may be usable with ammunition such as .40 caliber ammunition and in a single stack configuration.

SUMMARY

The firearm magazine of the invention is disclosed and depicted in the figures, the details and features of which are incorporated into this specification. The firearm magazine may include a magazine casing made of a metal or polymer, and may include a polymer follower designed to interface with the magazine casing to reduce splay or wobble of the follower as it travels within the casing. The magazine casing may further be configured to prevent the follower from popping out of the feed end of the magazine. The magazine may also include a floor plate secured at an end opposite of the feed end. The disclosed magazine is a single stack magazine and may be used with .40 caliber ammunition with an AR-style firearm, and also may be used with other ammunition.

BRIEF DESCRIPTION OF THE DRAWINGS

The present invention is illustrated by way of example and not limited in the accompanying figures in which like reference numerals indicate similar elements and in which.

DETAILED DESCRIPTION OF CERTAIN PREFERRED EMBODIMENTS

Figure 3:
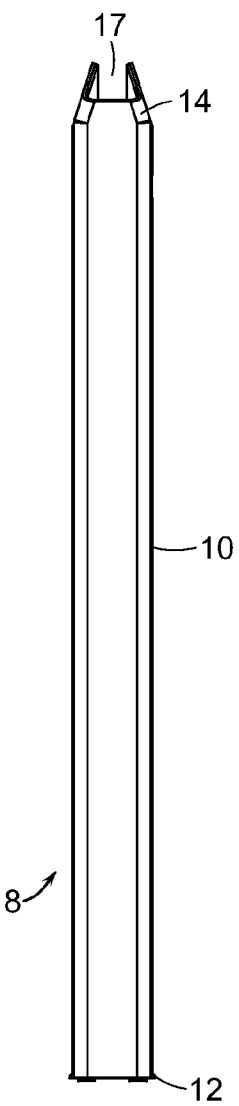
FIG. 3 illustrates an elevated end view of the magazine of FIG. 1.
Figure 2:
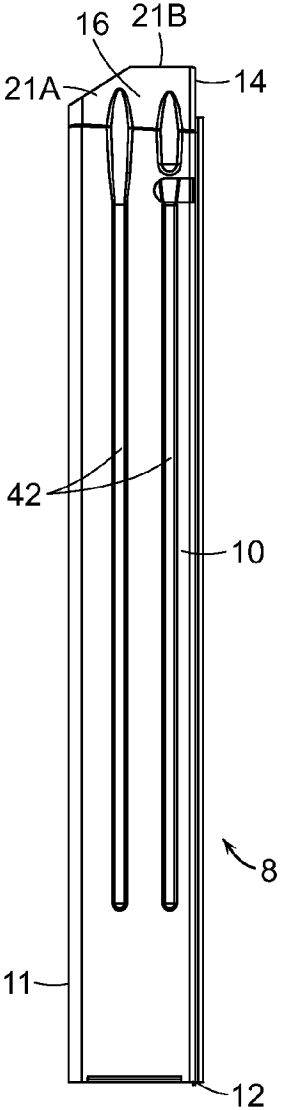
FIG. 2 illustrates a side view of the magazine of FIG. 1.
Figure 1:
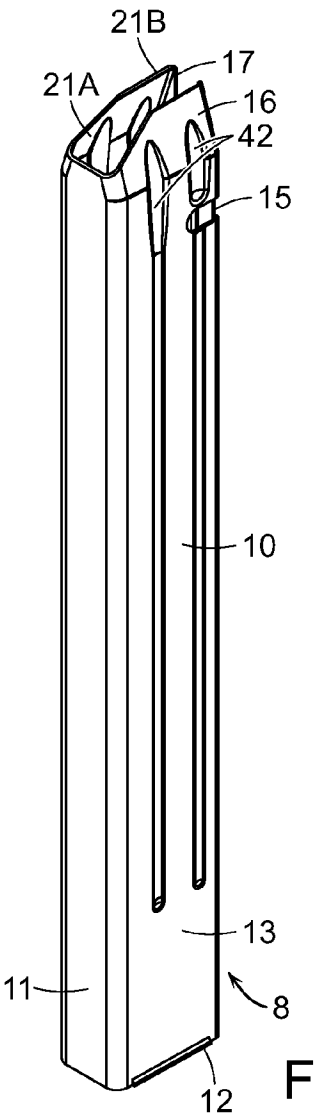
FIG. 1 illustrates an isometric view of an exemplary firearm magazine.

Referring to FIGS. 1-20, an exemplary magazine 8 and its components are depicted, and such a magazine may be used with .40 caliber ammunition, or other ammunition. The magazine is a single stack magazine and is configured to interface with the magazine well and bolt assembly of an AR-style firearm or similar firearm. In certain embodiments, the magazine is sized to accommodate 30 rounds of ammunition. The size of the magazine may be modified to accommodate more or fewer rounds, as desired.

The exemplary magazine 8 may include a magazine casing, housing, or body 10 having end walls 11, side walls 13, a bottom or floor end 12, and an opposite feed end 14. Feed end 14 includes feed walls or lips 16 that are used to guide a single cartridge from a single stack into the firearm's chamber for firing. Feed lips 16 are sized, shaped and configured as shown in the figures to permit the magazine to operate with a .40 caliber round. It should be understood that feed lips 16 may be modified to accommodate other sized rounds. Feed lips 16 define a ramp and form an opening 17 at feed end 14 that is sized to permit the .40 caliber round to pass between feed lips 16.

Figure 15:
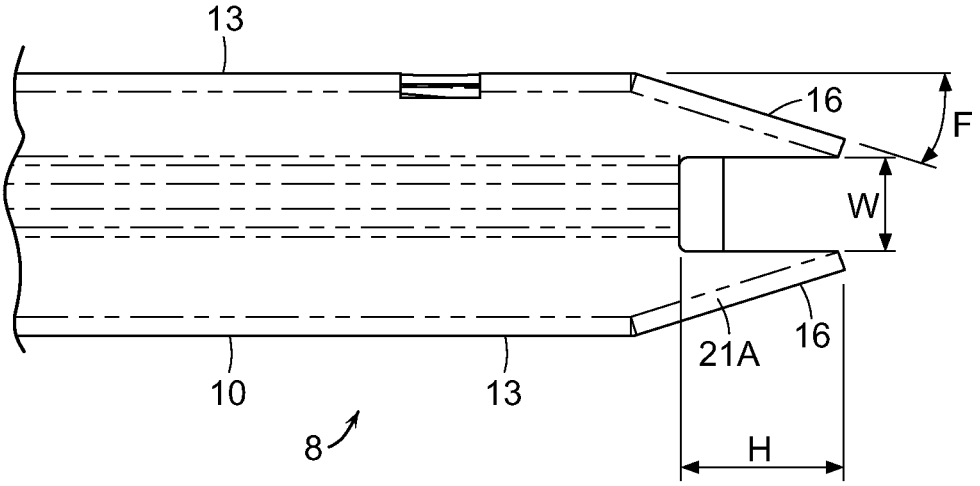
FIG. 15 illustrates a partial end view of the magazine of FIG. 1 illustrating the feed end.

In an exemplary embodiment, feed lips 16 at opening 17 define a height H of opening 17 between a top of end wall 11 of the body and a top of the feed lips of 0.528 inches, as shown in FIG. 15. Also as shown in FIG. 15, opening 17 has an inside width W of approximately 0.300 inches. As used herein, the term approximately is intended to mean approximately, within the constraints of sensible, commercial engineering objectives, costs and capabilities in the field of firearm manufacturing.

Figure 14:
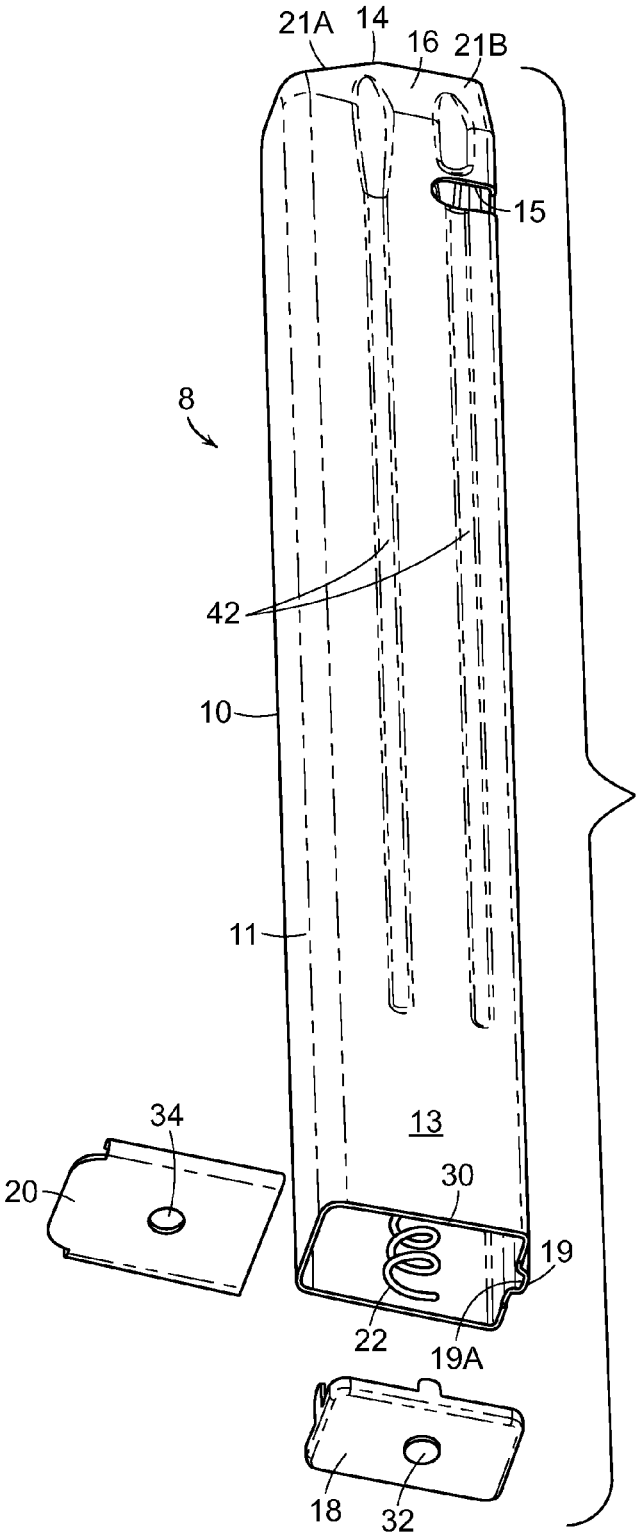
FIG. 14 is a perspective view of the magazine of FIG. 1 showing, in exploded form, the lock plate and a sliding plate at the floor end of the magazine.
Figure 16:
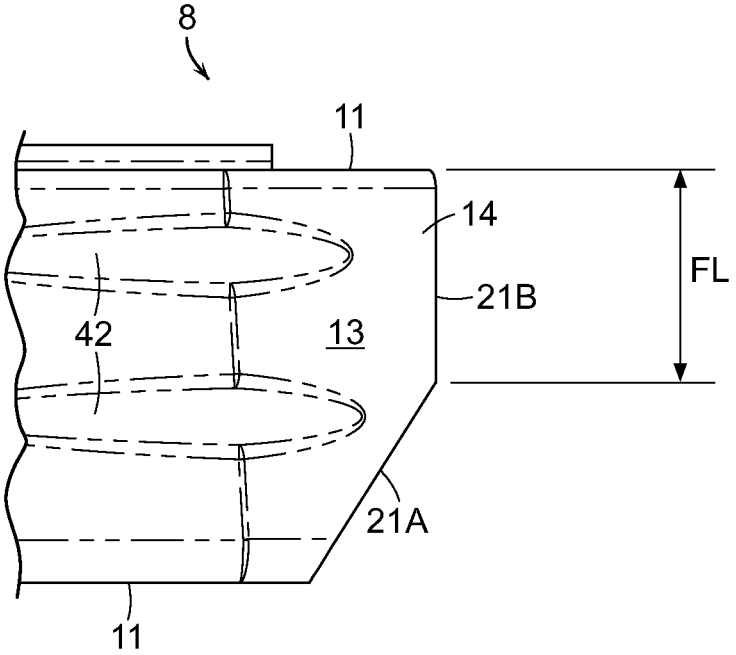
FIG. 16 illustrates a partial end view of the magazine of FIG. 1 illustrating the feed end.
Figure 17:
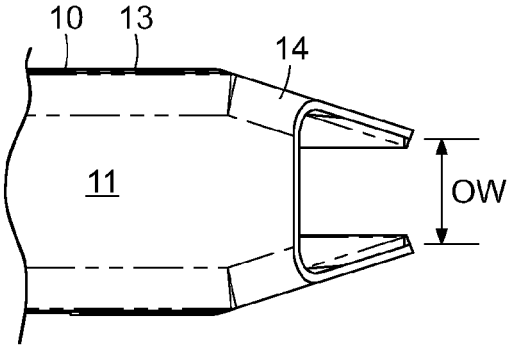
FIG. 17 illustrates a partial end view of the magazine of FIG. 1 illustrating the feed end.

The outside width OW of opening 17 which includes the thickness of the walls of feed lips 16 is approximately 0.360 inches, as shown in FIG. 17. Feed lips 16 angle inwardly toward a center of magazine body 10. The angle F of feed lips 16 relative to the side walls of the magazine body 10 is approximately 17.4 degrees, as shown in FIG. 15. As seen in FIG. 16, each feed lip 16 includes a first sloped portion 21A angled upwardly from a top of one of sidewalls 13 to and a second flat top portion 21B. Flat top portion 21B may have a length FL of approximately 0.685 inches, as shown in FIG. 14.

Figure 4:
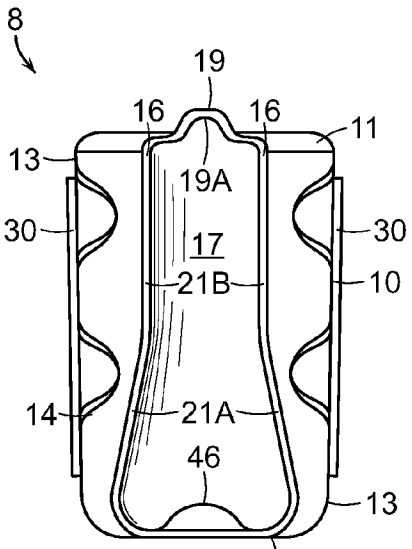
FIG. 4 illustrates a plan view of the magazine of FIG. 1.
Figure 5:
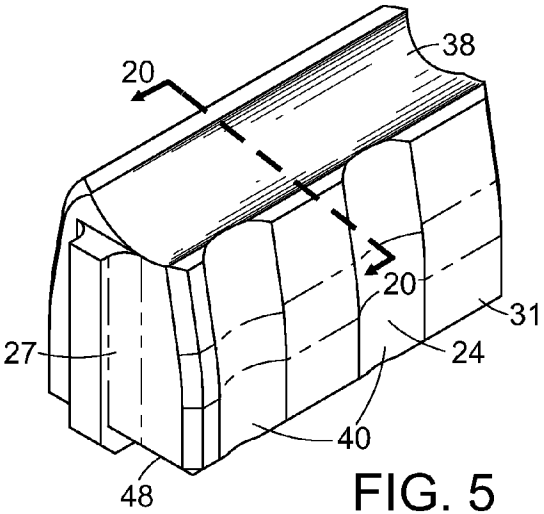
FIG. 5 illustrates an isometric top view of an exemplary magazine follower for use with the magazine of FIG. 1.
Figure 6:
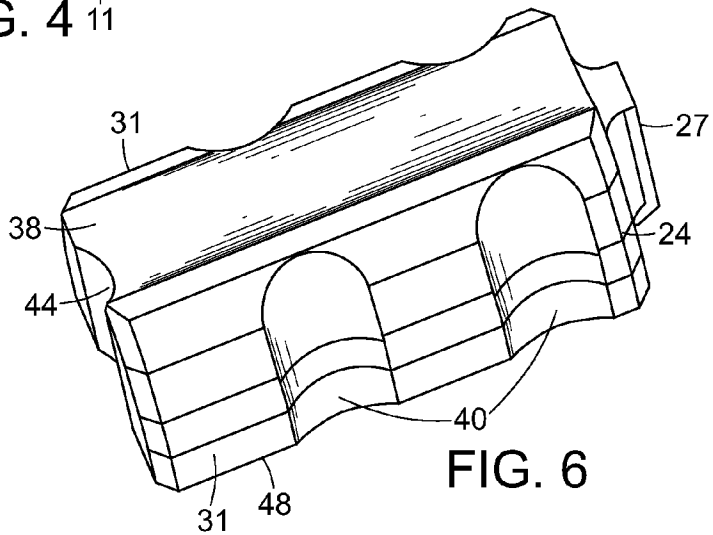
FIG. 6 illustrates another isometric top view of the follower of FIG. 5.
Figure 7:
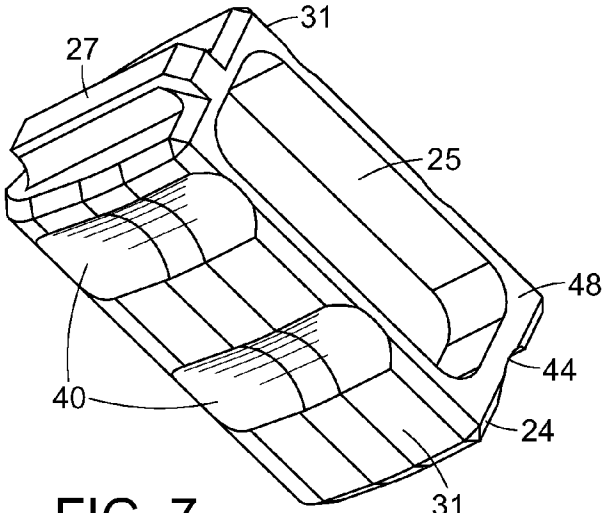
FIG. 7 illustrates another isometric bottom view of the follower of FIG. 5.
Figure 8:
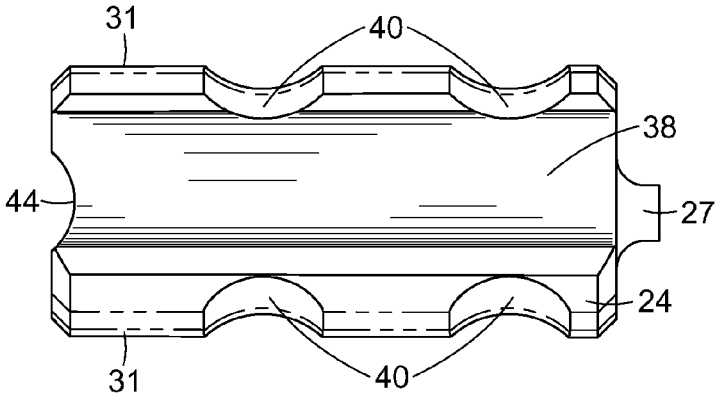
FIG. 8 illustrates a top view of the follower of FIG. 5.

In an exemplary embodiment, an end wall 11 of magazine body 10 has an elongated projection 19 that protrudes outwardly from the body, defining an elongated channel 19A on the interior of body 10, as shown in FIGS. 4 and 16. The interior surface of channel 19A is configured to interface with a ridge 27 formed on a follower 24, shown in FIG. 5 and described in greater detail below, such that ridge 27 of follower 24 will travel along channel 19A. In the exemplary embodiment, the exterior surface of projection 19 is located at a distance D approximately 0.080 inches outwardly from end wall 11, as shown in FIG. 16.

The inside corners where projection 19 extends outwardly from the exterior of body 10 may have a radius RI of approximately 0.030 inches, and the outside corners of projection 19 may have a radius RO of approximately 0.060 inches.

The casing or body 10 may be made of metal or a polymer. Body 10 may include a cut-out 15 formed proximate feed end 14 and extending completely through sidewall 13 of body 10 that serves as a magazine catch.

Figure 9:
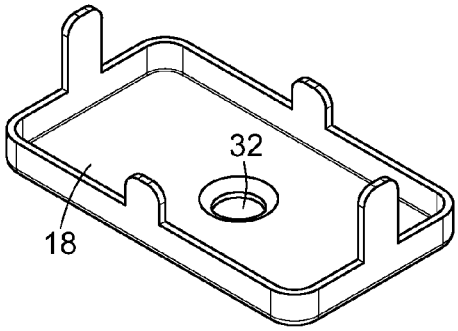
FIG. 9 illustrates an isometric view of an exemplary floor plate for use with the magazine of FIG. 1.
Figure 10:
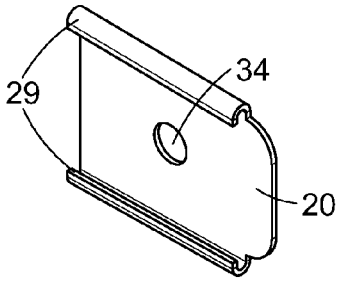
FIG. 10 illustrates an isometric view of an exemplary lock plate for use with the magazine of FIG. 1.
Figure 11:
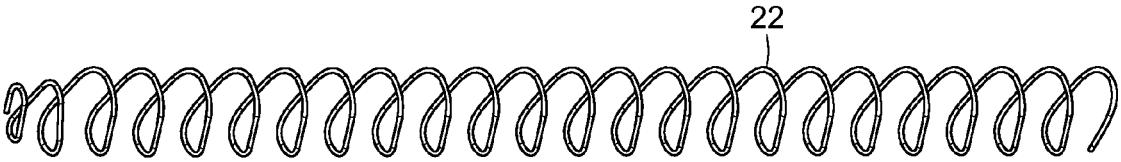
FIG. 11 illustrates an isometric view of an exemplary spring for use with the magazine of FIG. 1.
Figure 12:
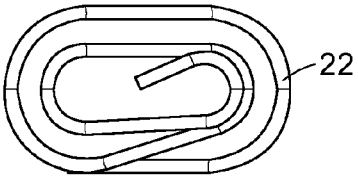
FIG. 12 illustrates an end view of the spring of FIG. 11.

A floor plate 18, as seen in FIG. 9, may be secured to floor end 12 of magazine 8 by a lock plate 20, seen in FIG. 10. A biasing member such as a seat spring 22, seen in FIGS. 11, 12, and 14, is positioned within magazine 8 below follower 24, and contacts and rests against floor plate 19 and lock plate 20. Seat spring 22 is used to bias follower 24 upwardly away from floor plate 18 so that follower 24 will move upwardly within magazine 8 as ammunition is used by firearm 5.

Figure 13:
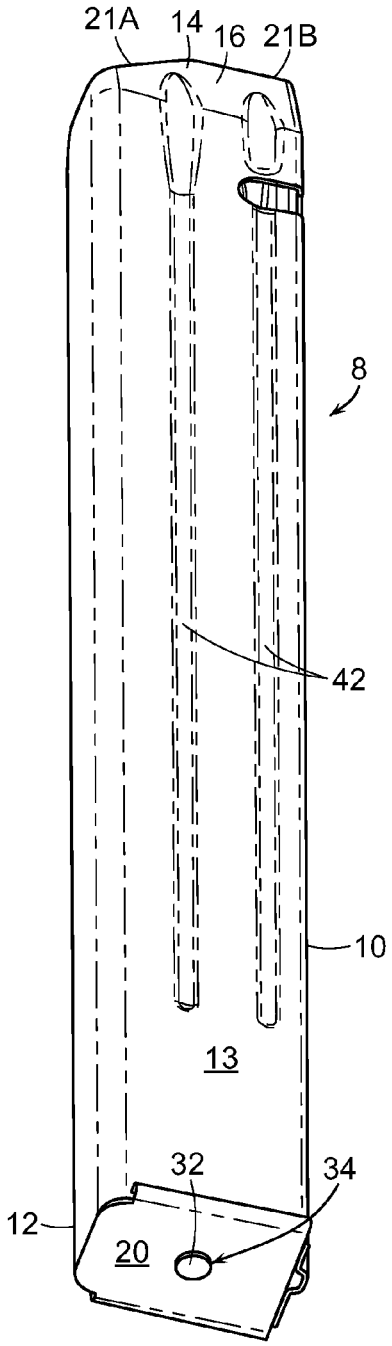
FIG. 13 illustrates a perspective view of the magazine of FIG. 1 showing the lock plate on the floor end of the magazine.
Figure 18:
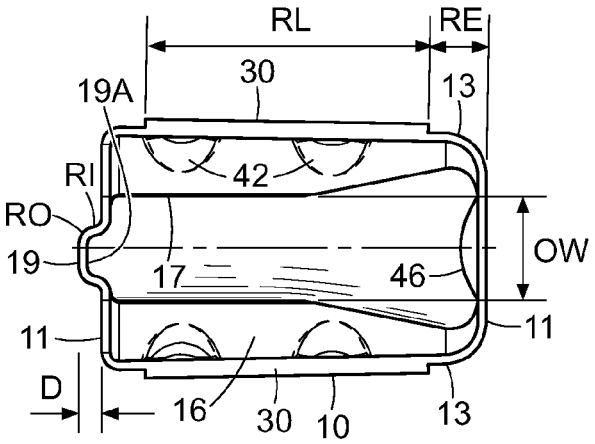
FIG. 18 illustrates a top view of the magazine of FIG. 1 illustrating the feed end.

As can be seen in FIGS. 13 and 14, floor plate 18 is inserted into floor end 12 of magazine 8. Lock plate 20 slides along underneath floor plate 18 on to floor end 12 of magazine 8. Curved lips 29 formed along sides of lock plate 20 slide over rims 30 extending outwardly from sidewalls 13, capturing lock plate 20. Rims 30 may have a length RL of approximately 0.978 inches, and a distance RE between an end of rims 30 and the outside of end wall 11 of body 10 may be approximately 0.204 inches, as seen in FIG. 18. Spring 22 acts to bias floor plate 18 downwardly onto lock plate 20. A boss or button 32 extends outwardly from the bottom of floor plate 18 and through an aperture 34 extending through lock plate 20. To remove lock plate 20 and floor plate 18, button 32 is pressed upwardly against the biasing force of spring 22 until it passes through aperture 34, at which time lock plate 20 can be slid along rims 30 away from magazine 8. Floor plate 18 can then be removed from magazine 8. Floor plate 18 and lock plate 20 interface together, and the force of spring 22 against floor plate 18 and lock plate 20 serves to prevent floor plate 20 from sliding off the bottom end 12 of body 10.

In certain embodiments, follower 24 is made of a polymer, but it is to be appreciated that follower 24 may also be made of other materials. Follower 24 includes a cavity 25 on its underneath side or bottom surface 48 that serves to receive and seat the upper end of spring 22. The follower is designed to push a single stack of ammunition through the magazine and out through the feed lips. Cavity 25 may have a width WC of approximately 0.411 inches as seen in FIG. 20. The top side of follower 24 may include the configuration shown in FIGS. 5-8, 17, 18. The top side of follower 24 is used to feed the ammunition held therein through feed lips 16. As depicted, side walls 31 of follower 24 may be tapered such that the upper end of follower 24 is narrower than its lower end, and the top side of follower 24 may include an arcuate feed surface 38. This configuration permits the feed of a single .40 caliber round through feed lips 16. Follower 24 may have a height FH of approximately 0.773 inches, as seen in FIG. 19.

Side walls 31 of follower 24 may include a plurality of grooves or side channels 40 that are sized and shaped to interface with elongated ribs or side ridges 42 (seen in FIG. 18) formed on the inside wall of body 10 of magazine 8. In one embodiment, follower 24 may include two pairs of opposing side channels 40. In certain embodiments side channels 40 are arcuate surfaces, and are defined by a radius of approximately 0.1875 inches, with side ridges 42 having an arcuate surface with the same radius. As noted above, an extension or elongated ridge 27 is formed on an end side of follower 24, and may be sized and shaped to match or interface with elongated channel 19A formed in body 10. An annular end channel 44 may be formed on an opposite end side of follower 24, and which interfaces with an elongated rib or end ridge 46 formed on an interior surface of an end wall 11 of body 10, as seen in FIGS. 4 and 18. The multiple side channels 40, end channel 44 and ridge 27 on follower 24 engage side ridges 42, end ridge 46 and channel 19A of body 10 to align follower 24 within body 10 so as to prevent splay or wobbling of follower 24 when spring 22 acts on the underside of follower 24 pushing follower 24 toward feed end 14 of body 10.

Figure 19:
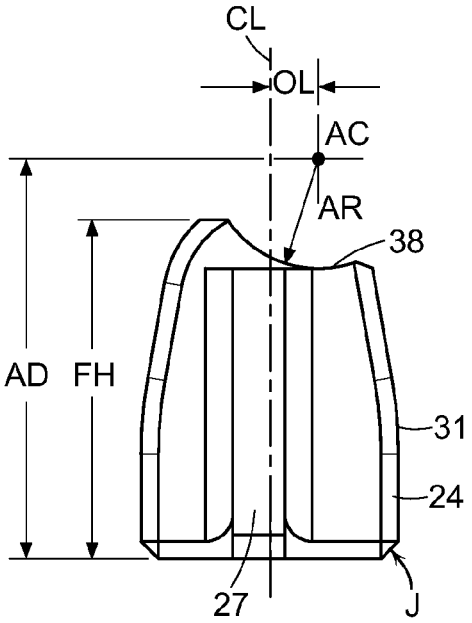
FIG. 19 illustrates a side view of the follower of FIG. 5.
Figure 20:
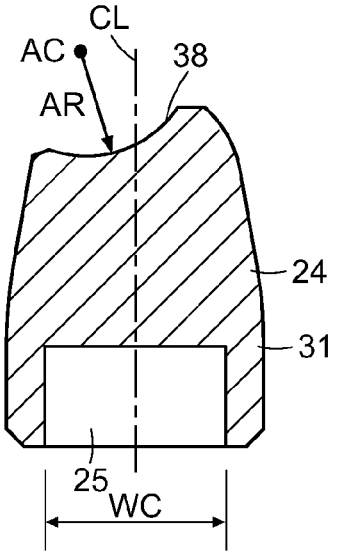
FIG. 20 illustrates a cross-section view of the follower, taken along line 20-20 of FIG. 5.

The junction J of side walls 31 and bottom 48 of follower 24 may be beveled at an angle of approximately 45° as seen in FIGS. 19-20. As noted above, a top of follower 24 may include arcuate feed surface 38. Feed surface 38 may have a radius AR of approximately 0.250 inches, which is measured from an end point AC of the radius. End point AC may be positioned at a distance AD above bottom 48 of follower 24, and distance AD may be approximately 0.912 inches. End point AC may be offset from a vertical centerline CL of follower 24 a distance OL of approximately 0.111 inches. With such an offset, a line along radius AR extending from the center of arcuate feed surface 38 does not extend vertically, but rather, extends upwardly and outwardly away from the center of arcuate feed surface 38.

It is to be understood that the invention is not limited in its application to the details of construction and the arrangement of the components set forth herein and illustrated in the drawings. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention.

What is claimed is:

1. A magazine for a firearm comprising:

a body having a bottom end, a feed end opposite the bottom, a pair of opposed side walls, a first end wall connecting the side walls with a channel on an interior surface of the first end wall, and a second end wall opposed to the first end wall and connecting the side walls, and a plurality of vertically extending side ridges, each side ridge positioned on an interior surface of one of the side walls;

a follower including:

a ridge along a first end wall thereof and configured to mate with the channel in the first end wall of the body;

a plurality of vertically extending side channels in sidewalls thereof, the side channels configured to mate with the side ridges of the body; and a concave arcuate feed surface extending along an uppermost surface thereof, an end point of a radius defining the arcuate feed surface being positioned above the uppermost surface and laterally offset from a vertically extending centerline of the follower; and a biasing member positioned between the follower and the bottom of the body.

2. The magazine of claim 1, wherein the end point of the radius is offset from the vertical centerline of the follower by approximately 0.111 inches.

3. The magazine of claim 1, wherein the end point of the radius is positioned approximately 0.912 inches above a bottom surface of the follower.

4. The magazine of claim 1, wherein the radius defining the arcuate feed surface is approximately 0.250 inches.

5. The magazine of claim 1, wherein each side wall of the follower includes a pair of side channels.

6. The magazine of claim 1, further comprising a vertically extending end ridge on an interior surface of the second end wall of the body, and a vertically extending end channel in a second end wall of the follower and configured to receive the vertically extending end ridge as the follower moves vertically within the body.

7. The magazine of claim 1, further comprising a cavity in a bottom surface of the follower and configured to receive an upper end of the biasing member.

8. The magazine of claim 1, further comprising a pair of opposed feed lips angled inwardly and upwardly from feed ends of the sidewalls.

9. The magazine of claim 8, wherein the feed lips are at an angle of approximately 17.4° with respect to the side walls.

10. The magazine of claim 8, wherein each feed lip includes a first sloped portion extending upwardly at an angle from the top of one of the side walls to a second flat portion.

11. The magazine of claim 8, wherein the feed lips define an opening having a height between a top of an end wall of the body and a top of the feed lips of 0.528 inches.

12. The magazine of claim 1, wherein the biasing member is a spring.

13. The magazine of claim 1, further comprising a cutout extending through one of the side walls of the body proximate the feed end of the body.

14. The magazine of claim 1, further comprising a floor plate positioned within the bottom end of the body and configured to engage a bottom end of the biasing member; and a locking plate engageable with the bottom end of the body to retain the floor plate within the body.

15. A magazine for a firearm comprising:

a body having a bottom end, a feed end opposite the bottom, a pair of opposed side walls, a first end wall connecting the side walls with a channel in an interior surface of the first end wall, and a second end wall opposed to the first end wall and connecting the side walls, a pair of feed lips angled inwardly and upwardly from feed ends of the sidewalls, each feed lip includes a first sloped portion extending upwardly at an angle from the top of one of the side walls to a second flat portion, and a plurality of vertically extending side ridges, each side ridge positioned on an interior surface of one of the side walls;

a follower including:

a ridge along a first end wall thereof and configured to mate with the channel in the first end wall of the body;

a plurality of vertically extending side channels in sidewalls thereof, the side channels configured to mate with the side ridges of the body;

a cavity in a bottom surface thereof; and a concave arcuate feed surface extending along an uppermost surface thereof, an end point of a radius defining the arcuate feed surface being positioned above the uppermost surface and laterally offset from a vertically extending centerline of the follower; and a spring having one end received in the cavity in the follower and an opposed end at the bottom end of the body.

16. The magazine of claim 15, wherein the end point of the radius is offset from the vertical centerline of the follower by approximately 0.111 inches.

17. The magazine of claim 15, wherein each side wall of the follower includes a pair of side channels.

18. The magazine of claim 15, further comprising a vertically extending end ridge on an interior surface of the second end wall of the body, and a vertically extending end channel in a second end wall of the follower configured to receive the vertically extending end ridge as the follower moves vertically within the body.

19. The magazine of claim 15, wherein the feed lips are at an angle of approximately 17.4° with respect to the side walls.

20. The magazine of claim 15, wherein the feed lips define an opening having a height between a top of an end wall of the body and a top of the feed lips of 0.528 inches.

21. The magazine of claim 15, further comprising a floor plate positioned within the bottom end of the body and configured to engage a bottom end of the biasing member; and a locking plate engageable with the bottom end of the body to retain the floor plate within the body.

22. A magazine for a firearm comprising:

a body having a bottom end, a feed end opposite the bottom, a pair of opposed side walls, a first end wall connecting the side walls with a channel on an interior surface of the first end wall, a second end wall opposed to the first end wall and connecting the side walls, a vertically extending ridge on an exterior of the second end wall, a pair of feed lips angled inwardly and upwardly from feed ends of the sidewalls, each feed lip including a first sloped portion extending upwardly at an angle from the top of one of the side walls to a second flat portion, a pair of vertically extending side ridges on an interior of each side wall, a floor plate seated within the bottom end of the body, and a locking plate engageable with the bottom end of the body;

a follower including:

a ridge along a first end wall thereof and configured to mate with the channel in the first end wall of the body as the follower moves within the body;

a pair of opposed side walls, each side wall including a pair vertically extending side channels, the side channels configured to mate with the side ridges of the body as the follower moves within the body;

a cavity in a bottom surface thereof;

an end channel formed in a second end wall thereof and configured to receive the end ridge of the body as the follower moves within the body; and a concave arcuate feed surface extending along an uupermost surface thereof, an end point of a radius defining the arcuate feed surface being positioned above the uppermost surface and laterally offset from a vertically extending centerline of the follower; and a spring having one end received in the cavity in the follower and an opposed end abutting the bottom plate.

23. The magazine of claim 22, wherein the end point of the radius is offset from the vertical centerline of the follower by approximately 0.111 inches.

24. The magazine of claim 22, wherein the radius defining the arcuate feed surface is approximately 0.250 inches.

25. The magazine of claim 22, wherein the feed lips are at an angle of approximately 17.4° with respect to the side walls.

26. The magazine of claim 22, wherein the feed lips define an opening having a height between a top of an end wall of the body and a top of the feed lips of 0.528 inches.

* * * * *